United States Patent [19]

Teodorescu et al.

[11] 4,200,425

[45] Apr. 29, 1980

[54] GAS-LIFT DEVICE

[75] Inventors: Constantin Teodorescu; Ilie Chiriac; Cornel D. Sava; Adrian Drăghici; Sabin Zinca, all of Bucharest, Romania

[73] Assignee: Institutul National Pentru Creatie Stiintifica Si Tehnica-Increst, Bucharest, Romania

[21] Appl. No.: 886,611

[22] Filed: Mar. 14, 1978

Related U.S. Application Data

[63] Continuation of Ser. No. 653,004, Jan. 28, 1976, Pat. No. 4,090,814.

[30] Foreign Application Priority Data

Feb. 12, 1975 [RO] Romania ..... 81391

[51] Int. Cl.[2] ..... F04F 5/44

[52] U.S. Cl. ..... 417/178; 417/197

[58] Field of Search ..... 417/160, 171, 172, 177, 417/178, 194, 195-198, DIG. 1; 239/DIG. 7; 137/155

[56] References Cited

U.S. PATENT DOCUMENTS

| | | | |
|---|---|---|---|
| 857,768 | 6/1907 | Stirling | 417/197 |
| 992,144 | 5/1911 | Babcock | 417/197 X |
| 1,737,684 | 12/1929 | Reynolds | 417/197 |
| 1,865,623 | 7/1932 | Eidsmore | 417/177 |
| 1,867,876 | 7/1932 | Clark | 417/195 |
| 2,608,801 | 9/1952 | Ridley | 417/195 |
| 3,022,685 | 2/1962 | Armacost | 417/DIG. 1 |
| 3,765,152 | 10/1973 | Pausch | 417/197 X |
| 3,784,325 | 1/1974 | Coanda et al. | 417/197 X |

*Primary Examiner*—Carlton R. Croyle
*Assistant Examiner*—Edward Look
*Attorney, Agent, or Firm*—Karl F. Ross

[57] ABSTRACT

A gas-lift device having upper and lower adapting members formed with throughgoing axial bores for the incorporation of the device in a well string, the adapting members being joined by a sleeve containing a profiled member, having an axial throughgoing bore, locked therein in juxtaposition with a profiled ring threaded onto the upper adapting member, the ring having an inner diameter less than that of the axial bore of the upper adapting member, so that an inwardly extending annular ledge is formed by the ring and an annular slot is defined between the annular ledge and the juxtaposed profiled member, the combination of annular ledge, annular slot and profiled member forming an upwardly directed turbulence nozzle, supplied with pressurized gas from a chamber formed in the sleeve.

3 Claims, 2 Drawing Figures

GAS-LIFT DEVICE

CROSS REFERENCE TO RELATED APPLICATION

This application is a continuation of our copending U.S. application, Ser. No. 653,004, filed Jan. 28, 1976, now U.S. Pat. No. 4,090,814 issued Mar. 23, 1978.

FIELD OF THE INVENTION

The present invention relates, in general, to gas-lift devices, and, more particularly, to a gas-lift device for the withdrawal of petroleum from a subterranean deposit whereby the device breaks up the petroleum to form a homogeneous mixture with the lifting gas.

BACKGROUND OF THE INVENTION

It has already been proposed to withdraw petroleum from a well when the pressure from below is no longer sufficient to lift the petroleum to the surface by itself, by using a device which introduces a lifting gas under pressure to a location below the surface of the petroleum in the subterranean deposit and thereby cause the petroleum to move upwardly along a string or casing. The lifting gas may be introduced under pressure continuously or intermittently at various levels along the string so that, at each such level, there is an elevating effect.

It is also known to provide a device for spraying the petroleum concurrently with the lifting thereof by the use of ejectors operating with venturi principles.

Both of these devices have the disadvantage that they require high working pressure and a high consumption of the lifting gas. When the petroleum is lifted in the form of slugs, i.e. units of the liquid moved as a mass, the slugs of petroleum alternate with the slugs of gas and there may occur a downward slippage of the crude oil along the inner wall of the casing reducing the quantity of oil withdrawn and leading to increased gas consumption.

There is still another known device using the Coanda effect. This device operates by means of pumping the lift gas through an annular space, previously sealed with a packer over the orifices. The gas is introduced into the string or casing at different levels through annular slots having adjustable openings. Above these slots there is formed a venturi nozzle allowing the fluid jet to deflect along the inner walls of the nozzle due to the Coanda effect and the active upward entrainment of the petroleum, concurrently with the dispersal of the slugs by their homogenization with the lifting gas.

The disadvantage of this particular device is its low efficiency, unsteady operation and great consumption of lift gases.

OBJECT OF THE INVENTION

It is, therefore, an object of the present invention to provide an improved gas-lift device for the withdrawal of petroleum from a subterranean deposit whereby the aforementioned disadvantages can be obviated.

SUMMARY OF THE INVENTION

The above and other objects and advantages of the invention will become more apparent in a gas-lift device in which a first cylindrical adapting member having a throughgoing axial bore is provided with external threads formed at both of its ends. The upper end of the adapting member is threaded into one end of the string or casing of the oil well, while the lower end of the adapter is threaded into the upper end of a sleeve, which in turn is formed with internal threads at its lower end, these threads ending at an inwardly stepped shoulder which acts as a stop for a second externally threaded adapting member for the other end of the string or casing into which it is threaded.

In the span between the bottom end of the adapting member and the inwardly stepped shoulder, there is provided an intermediate member having a throughgoing axial bore and formed with external threads at its lower end which engage with internal threads formed in the sleeve above the shoulder. The threaded portion of the intermediate member is further provided with a radial slot formed near the lower end thereof which is spanned by a set screw threaded into the bottom end of the intermediate member and bearing against the upper surface of the slot, so that the set screw can be used to force the portion of the member between the slot and the bottom end downwardly, thereby locking the intermediate member in place within the sleeve, so that the upper end of the intermediate member lies in a common plane with the bottom end of the adapting member, transverse to the axis of the gas-lift device.

The lower end of the adapting member is formed with a stepped portion which is externally threaded and of a slightly smaller diameter than the rest of the adapter, so that a shoulder is formed. Threaded onto this portion is a profiled ring which abuts the shoulder and extends below the lower end of the adapter, with an internal diameter slightly smaller than the internal diameter of the adapter, so that an annular ledge is formed, lying in the same plane with the bottom end of the adapter and the upper end of the intermediate member.

The upper portion of the intermediate member is formed with an inwardly curved annular zone on its outer surface which extends upwardly to the upper end of the intermediate member and lies inwardly of the annular ledge of the ring, so that an annular slot is defined therebetween, which together with the ledge and the upper end of the intermediate member form a turbulence nozzle directed axially upwardly.

The annular slot formed by the profiled ring and the intermediate member extends downwardly and outwardly in an ever widening gap which communicates with an annular distribution chamber formed in the inner wall of the sleeve and provided with an inlet through which the lift gases are supplied.

The gas-lift device is so designed that it can be placed anywhere along the length of the well string and gas introduced into the distribution chamber under pressure, which directs it in an even manner to the annular slot and the turbulence nozzle, where the gas rapidly expands in a turbulent manner, thoroughly mixing with and entraining the petroleum, while at the same time creating a pressure drop which serves to draw the petroleum below the gas-lift device up the well string.

In addition, the inner surfaces of the bores formed in the adapting member and the intermediate member are coated with metallic oxides to reduce the abrasive effects of the sand which is usually entrained in the petroleum flow.

BRIEF DESCRIPTION OF THE DRAWING

The above and other objects, features and advantages of the invention will become more readily apparent from the following description, reference being made to the accompanying drawing, in which.

SPECIFIC DESCRIPTION

Figure 1:
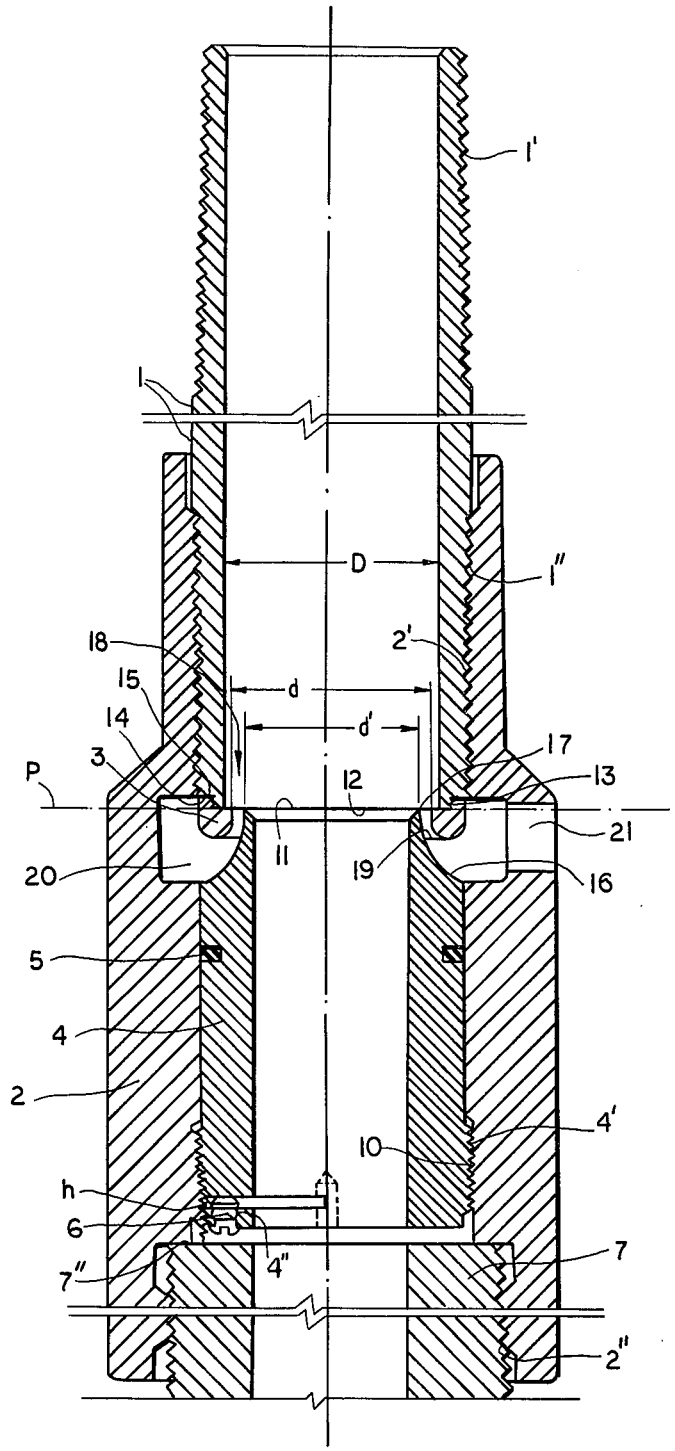
FIG. 1 is an axial sectional view of the gas-lift device according to the invention.
Figure 2:
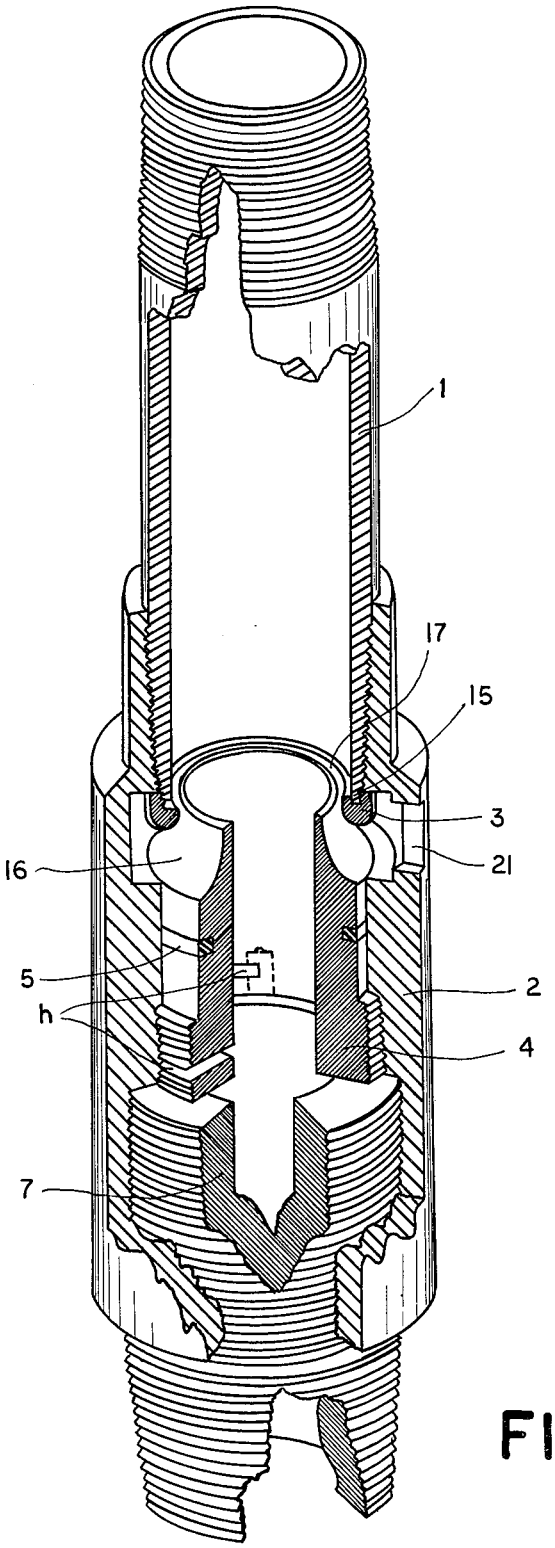
FIG. 2 is a perspective view with parts broken away of the device of FIG. 1.

The gas-lift device shown in FIGS. 1 and 2 is designed to be interfitted in a well string, and to this end there is provided a first adapter member 1 having a throughgoing axial bore and formed at its upper end with external threads 1' for engagement with the well string and at its lower end with external threads 1", which engage the internal threads 2' formed in the upper portion of a sleeve 2, which is further provided with internal threads 2" formed in its lower portion and ending in an inwardly stepped shoulder 7', which acts as a stop for a second externally threaded adapting member 7 on which it is engaged and which in turn engages the other end of the well string.

In the span between the lower end of member 1 and the shoulder 7", there is provided a cylindrical intermediate member 4 having a throughgoing axial bore and formed with external threads 4' at its lower end which engage with internal threads 10 formed in the sleeve 2 above the shoulder 7". A sealing ring 5 is provided in a peripheral groove of the member 4 and bears against the inner wall of the sleeve 2. The threaded portion 4' of member 4 is provided with a radial slot h, which is spanned by a setscrew 6 threaded into the bottom end of member 4 and bearing against the upper surface of slot h, so that the setscrew 6 can be used to force the lip 4", defined between slot h and the bottom end of member 4, downwardly, thereby locking member 4 in place within sleeve 2, with the upper end 11 of member 4 lying in a common plane P with the bottom end 12 of adapter 1, transverse to the axis of the gaslift device.

The lower end of adapter 1 is formed with a stepped portion 13 which is externally threaded and of a slightly smaller diameter that the rest of the adapter, so that a shoulder 14 is formed. Threaded onto portion 13 is a profiled ring 3 which abuts the shoulder 14 and extends below the end 12 of adapter 1, with an internal diameter d slightly smaller than the internal diameter D of the axial bore of adapter 1, so that an annular ledge 15 is formed, lying in the same plane P as the end 12 of adapter 1 and the top end 11 of member 4.

The upper portion of member 4 is formed with an inwardly curved annular surface 16 which extends upwardly and intersects the end 11 and forms a ring having a diameter d', slightly smaller than the diameter d of ring 3, thereby defining therewith an annular slot 17, which together with the ledge 15 and the end 11 form a turbulence nozzle 18 directed axially upward. The annular slot 17 extends downwardly in an ever widening gap 19, defined by the profiled ring 3 and the curved surface 16, into an annular distribution chamber 20 formed in the inner wall of sleeve 2 and provided with an inlet 21 through which the lift gases are supplied.

In operation, the gas-lift device is positioned in a well string and fed with gas under pressure through the inlet 21 and the chamber 20, which directs it in an even manner through the annular gap 19 to the annular slot 17, where, upon emerging, the gas rapidly expands in a turbulent manner, thoroughly mixing with and entraining the petroleum, while at the same time creating a pressure drop in the device which serves to draw the petroleum below the gas-lift device up the well string. The amount of turbulence and the pressure drop created can be regulated by interchanging the ring 3 with others of different dimensions, thereby changing the width of the annular slot 17.

I claim:

1. A gas-lift device to be fitted in a well string for the withdrawal of petroleum from a subterranean deposit, comprising:

a first cylindrical adapting member having a throughgoing axial bore and provided with external threads adjacent the upper and lower ends thereof, said upper threads being engagable with said well string;

a cylindrical sleeve having internal threads formed adjacent the upper and lower ends thereof, said upper internal threads engaging said lower external threads of said first adapting member;

a second adapting member having a throughgoing axial bore and formed with external threads engaging said lower internal threads of said sleeve against an inwardly stepped shoulder thereof, said second adapting member being engageable with said well string;

a cylindrical intermediate member having a throughgoing axial bore, said intermediate member being threadly received in said sleeve between said shoulder and said first adapting member, said intermediate member being provided with a radial slot formed near the lower threaded end thereof defining a deflectable portion therewith, said deflectable portion being spanned by a set screw axially threaded therein and bearing against the upper surface of said slot for locking said intermediate member in said sleeve with the upper end thereof in a common transverse plane with the lower end of said first adapting member, said intermediate member being further provided with an inwardly curved and upwardly extending annular portion formed in the periphery thereof and adjacent said upper end thereof, said upper end lying inwardly of the wall of said axial bore in said first adapting member;

a profiled ring formed with an internally threaded step engaging an externally threaded step formed adjacent said lower end of said first adapting member, said ring extending below said lower end of said first member and having an inner diameter lying inwardly of the wall of said axial bore and forming an annular ledge therewith, said annular ledge lying outwardly of said upper end of said intermediate member and in the same plane therewith; and an upwardly directed annular slot formed between said annular ledge and said upper end of said intermediate member, and forming a turbulence nozzle therewith, said slot extending downwardly and outwardly in an increasingly widening gap defined between said profiled ring and said inwardly curved and upwardly extending annular portion of said intermediate member, said gap communicating with an annular distribution chamber formed in the inner surface of said sleeve, said chamber being supplied with pressurized gas through an inlet formed in the wall of said sleeve.

2. A gas-lift device defined in claim 1 wherein, with the purpose of increasing the efficiency and reducing the lift gas consumption, it consists of a cylindrical adapting member at the lower end of which is mounted, by screwing on a profiled ring a sleeve in which is screwed internally an intermediate member having a displaceable lip formed by a slot in its lower portion which permits the blockage of sleeves by a setscrew; a nozzle for supplying liftgases, formed of a distribution chamber edged by a profiled inner wall of the intermediate member by a curved profile of the profiled ring and by the inner wall of the sleeve for the communication of the nozzle with the gas supplying duct being provided with some inlets formed circumferentially in the wall of the threaded sleeve; an annular periphery slot formed between the profiled inner wall of the intermediate member and the curved profile of the ring; and a turbulence nozzle formed at the exit end of the peripheral annular slot.

3. A gas-lift device according to claim 2 wherein the turbulence nozzle formed by the ring may be correspondingly dimensioned as to obtain slots with different dimensions imposed by the lifting depth.

* * * * *